US007780883B2

(12) United States Patent
Amagasa et al.

(10) Patent No.: US 7,780,883 B2
(45) Date of Patent: Aug. 24, 2010

(54) METHOD AND APPARATUS OF PRODUCING FIBROUS AGGREGATE

(75) Inventors: Masahiro Amagasa, Ibaraki (JP); Yukio Kojima, Ibaraki (JP); Masaaki Kawabe, Ibaraki (JP)

(73) Assignee: Japan Vilene Company, Ltd., Tokyo (JP)

( * ) Notice: Subject to any disclaimer, the term of this patent is extended or adjusted under 35 U.S.C. 154(b) by 1200 days.

(21) Appl. No.: 11/229,795

(22) Filed: Sep. 19, 2005

(65) Prior Publication Data

US 2006/0060999 A1 Mar. 23, 2006

(30) Foreign Application Priority Data

Sep. 17, 2004 (JP) ..... 2004-271014

(51) Int. Cl.
*B29B 9/00* (2006.01)

(52) U.S. Cl. ..... 264/10; 425/8

(58) Field of Classification Search ..... 264/10; 425/8

See application file for complete search history.

(56) References Cited

U.S. PATENT DOCUMENTS 4,650,506 A 3/1987 Barris et al.
4,842,505 A 6/1989 Annis et al.
6,520,425 B1 * 2/2003 Reneker ..... 239/294
6,616,435 B2 9/2003 Lee et al.
2003/0106294 A1 * 6/2003 Chung et al. ..... 55/486

FOREIGN PATENT DOCUMENTS

GB 785394 10/1957

* cited by examiner

*Primary Examiner*—Joseph D Del Sole
*Assistant Examiner*—John P Robitaille
(74) *Attorney, Agent, or Firm*—Heslin Rothenberg Farley & Mesiti, P.C.

(57) ABSTRACT

A method of producing fibrous aggregate, comprising: a supplying and discharging step in which a fiberizable liquid is supplied from a means for storing a fiberizable liquid to a means for discharging a fiberizable liquid via a supplying pipe, and the fiberizable liquid is discharged from the discharging means; and a fibers-collecting step in which fibers drawn and fiberized by applying an electrical field to the discharged fiberizable liquid are accumulated directly on a collecting surface of a collector while the collecting surface is unidirectionally conveyed to form the fibrous aggregate;

wherein the discharging means is carried on a support capable of moving along an endless track capable of rotationally travelling between a pair of rotating shafts, and the fiberizable liquid is discharged from the discharging means while the support is revolved at a constant velocity under the condition that a moving direction of a linear motion area in the endless track conforms to a width direction of the collecting surface is disclosed.

10 Claims, 2 Drawing Sheets

METHOD AND APPARATUS OF PRODUCING FIBROUS AGGREGATE

CROSS REFERENCE TO RELATED APPLICATIONS

This application claims priority from Japanese patent application No. 2004-271014, filed on 17 Sep. 2004, the entire disclosure of which is incorporated herein by reference.

BACKGROUND OF THE INVENTION

1. Field of the Invention

The present invention relates to a method of and apparatus for producing fibrous aggregate.

2. Description of the Related Art

When fibers constituting a fibrous aggregate have small diameters, the fibrous aggregate exhibits various excellent properties, such as filtration properties, liquid retention properties, wiping-off properties, shielding properties, insulating properties, or pliability. Therefore, it is preferable to reduce the diameter of the fibers constituting the fibrous aggregate. Production of the fibrous aggregate composed of fibers having small diameters is carried out by exists a process comprising discharging fiberizable liquid from nozzles, and at the same time, applying an electrical field to the discharged fiberizable liquid to draw the fiberizable liquid, producing fibers having a small diameter, and then directly collecting the fibers to prepare the fibrous aggregate; that is an electrostatic spinning process.

When the fibrous aggregate is produced by a single nozzle in the electrostatic spinning process, the fiberizable liquid is discharged in a small amount, and as a result, productivity is lowered. Thus, methods wherein two or more nozzles are employed to enhance the productivity are proposed. For example, an apparatus for producing a polymeric web, comprising a fiber-forming part for injecting the fiberizable liquid through multi-nozzles composed of plural needles to a collector was proposed (Patent Reference No. 1). A rotating disk device for discharging from two or more discharging holes was also proposed (Patent Reference No. 2). Further, a discharging device which can move across a collector (such as a tube), and a collector which can counter-rotate were disclosed (Patent Reference No. 3).

Patent Reference No. 1: U.S. Pat. No. 6,616,435
Patent Reference No. 2: U.S. Pat. No. 4,650,506
Patent Reference No. 3: U.S. Pat. No. 4,842,505

SUMMARY OF THE INVENTION

However, when the apparatus for producing a polymeric web, comprising the fiber-forming part having the multi-nozzles composed of plural needles (Patent Reference No. 1) was used, only a polymeric web, i.e., a fibrous aggregate, wherein the center of the aggregate contains a large quantity of fibers but both edges of the aggregate contain a small quantity of fibers in the direction of the width of the aggregate, i.e., in the direction perpendicular to the moving direction of the collector, was produced. It appeared that a fiber formed when discharged from a nozzle was influenced by an electrical field generated by an electrical charge of other fibers formed when discharged from other nozzles, and thus, an uneven dispersion of the amounts of the fibers was caused in the width direction of the fibrous aggregate. For example, in the apparatus disclosed in the Patent Reference No. 1, nozzles are placed in a zigzag manner and thus the spaces therebetween are relatively wide, as shown in FIG. 4C. Therefore, it was expected that the influence by the electric field generated by the electric charges of the fibers formed when discharged from other nozzles would be reduced, and a fibrous aggregate having lesser dispersion unevenness in the fiber amount in the width direction could be produced. However, a variation of nozzle diameters caused an unevenness of the discharging amount, and thus the amount of the fibers became uneven. Further, the states of the collector were different between the cases when the collector received the fibers discharged from nozzles in the first line, those in the second line, and those in the n-th line. The collector was not able to collect the fibers in an identical condition from the nozzles in each line. As a result, the uneven dispersion of the fiber amount in the width direction of the fibrous aggregate was not able to be reduced.

Under the circumstances, the present inventors made attempts to reduce the uneven dispersion of the fiber amount in the width direction of the fibrous aggregate by reciprocating, in a direction of the width of the collector, two kinds of nozzle groups; i.e., (1) a nozzle group having two or more nozzles linearly arranged in a direction perpendicular to a conveying direction of the collector, and (2) a nozzle group having two or more nozzles linearly arranged in a direction parallel to the conveying direction of the collector. However, in the case of the above nozzle group (1) wherein the nozzles were linearly arranged in the perpendicular direction, the nozzle group had to stop once for the reciprocating movement, and the fiber amount at and near to the positions where the nozzle group stopped was increased. There were two stopping positions for each nozzle. Therefore, the uneven dispersion of the fiber amount in the width direction of the fibrous aggregate was generated continuously in a longitudinal direction of the fibrous aggregate. Further, because the variation of the nozzle diameters directly caused the uneven dispersion of the fiber amount, the unevenness of a unit weight per unit area was increased.

On the other hand, in the case of the above nozzle group (2) wherein the nozzles were linearly arranged in the parallel direction, each nozzle reciprocated from one edge to the other edge of the collector, and thus, it was not observed that the uneven dispersion of the fiber amount in the width direction of the fibrous aggregate was generated continuously in the longitudinal direction thereof as above. However, the nozzle group also had to stop once for the reciprocating movement, as above. Only one nozzle was provided in the width direction of the collector, and thus, an extreme acceleration and slowdown were required. This had the result that portions including a large quantity of fibers were generated in both edges of the fibrous aggregate. When the productivity was enhanced by increasing the width of the collector, a velocity of the nozzle group had to be increased, because a slow velocity of the nozzle group caused the generation of a portion containing a large quantity of fibers and a portion containing a small quantity of fibers in a longitudinal direction of the fibrous aggregate. However, a higher velocity of the nozzle group required a wider portion necessary for the acceleration and slowdown, in proportion with the increase of the velocity. This had the result that the uneven dispersion of the fiber amount in the width direction of the fibrous aggregate was promoted.

The rotating disk device for discharging (Patent Reference No. 2) can produce only a fibrous aggregate containing a central portion with a small quantity of fibers and both edges with a large quantity of fibers.

In the apparatus having the collector capable of counter-rotating (Patent Reference No. 3), there inevitably existed a time zone of a high rotating velocity and a time zone of a low rotating velocity, so as to counter-rotate the collector. This resulted in a fibrous aggregate with unevenness in the fibers-orientation, and thus, mechanical strength. The Patent Reference No. 3 also discloses that guard plates are positioned at the boundary portions between adjacent collectors, so as to continuously form fibers. However, the fibers deposited on the guard plates with a fiber-forming procedure gave the plates an insulating property. Thus, an amount of the fibers discharged was decreased when the discharging portion reached the guard plates, and in turn, an amount of the fibers was liable to be increased when the discharging portion reached the collectors adjacent to the guard plates, because the decreased amount was also discharged thereat. Therefore, a fibrous aggregate with an uneven dispersion of the fiber amount was liable to be produced.

The present invention was completed in order to remedy the disadvantages of the above-mentioned prior art. The object of the present invention is to provide a method and an apparatus which can produce a fibrous aggregate wherein an amount of fibers is uniformly even in a width direction thereof. More particularly, the object of the present invention is to provide a method and an apparatus which can produce a fibrous aggregate wherein an amount of fibers is uniformly even in a width direction thereof, with a high productivity.

Accordingly, the present invention relates to a method of producing fibrous aggregate, comprising:

a supplying and discharging step in which a fiberizable liquid is supplied from a means for storing a fiberizable liquid to a means for discharging a fiberizable liquid via a supplying pipe, and the fiberizable liquid is discharged from the discharging means; and a fibers-collecting step in which fibers drawn and fiberized by applying an electrical field to the discharged fiberizable liquid are accumulated directly on a collecting surface of a collector while the collecting surface is unidirectionally conveyed to form the fibrous aggregate;

wherein the discharging means is carried on a support capable of moving along an endless track capable of rotationally travelling between a pair of rotating shafts, and the fiberizable liquid is discharged from the discharging means while the support is revolved at a constant velocity under the condition that a moving direction of a linear motion area in the endless track conforms to a width direction of the collecting surface.

According to a preferable embodiment of the present method, the support carries thereon two or more means for discharging a fiberizable liquid.

According to another preferable embodiment of the present method, the supplying and discharging step and the fibers-collecting step are carried out under the condition that an electrically conductive material is positioned in a part of or throughout the supplying pipe.

According to a still another preferable embodiment of the present method, the supplying and discharging step and the fibers-collecting step are carried out under the condition that a gas having a desired relative humidity is supplied around the means for discharging a fiberizable liquid.

According to a still another preferable embodiment of the present method, the supplying and discharging step and the fibers-collecting step are carried out while an electrical field is applied from an outside of the endless track of the support.

The present invention also relates to an apparatus of producing fibrous aggregate, comprising a means capable of storing a fiberizable liquid;

a means capable of discharging a fiberizable liquid;

a supplying pipe connecting the storing means and the discharging means;

a supplying and discharging means capable of supplying a fiberizable liquid from the storing means to the discharging means, and discharging the fiberizable liquid from the discharging means;

a voltage applying means capable of applying an electrical field to a fiberizable liquid discharged by an action of the supplying and discharging means to conduct drawing and fiberization;

a collector having a collecting surface on which fiberized fibers are directly accumulated, and capable of forming a fibrous aggregate while the collecting surface is unidirectionally conveyed;

a support capable of moving along an endless track capable of rotationally travelling between a pair of rotating shafts, and carrying thereon the discharging means so that the discharging means is able to be conveyed along the endless track, wherein a moving direction of a linear motion area in the endless track conforms to a width direction of the collecting surface; and a means capable of rotationally conveying the support along the endless track at a constant velocity.

According to a preferable embodiment of the present apparatus, the support carries thereon two or more means capable of discharging a fiberizable liquid.

According to another preferable embodiment of the present apparatus, an electrically conductive material is positioned in a part of or throughout the supplying pipe.

According to a still another preferable embodiment, the present apparatus further comprises a means capable of supplying a gas having a desired relative humidity around the means for discharging a fiberizable liquid.

According to a still another preferable embodiment, the present apparatus further comprises a means capable of applying an electrical field from an outside of the endless track of the support.

According to the present method, the means for discharging a fiberizable liquid, i.e., the discharging means, is carried on the support and rotationally travels along the endless track at a constant velocity while discharging a fiberizable liquid, and thus, a fibrous aggregate having an even dispersion of the fiber amount in a width direction thereof can be produced. Further, the fibers constituting the fibrous aggregate are intersected with each other, and thus a resulting fibrous aggregate has an even mechanical strength in various directions thereof.

When the support has thereon two or more means for discharging a fiberizable liquid along the endless track in the present method, an amount of the fiberizable liquid discharged can be increased, and so the fibrous aggregate can be manufactured with a good productivity. Further, even if the pore diameters of the discharging means are not uniform in size, the fibrous aggregate having an even dispersion of the fiber amount in a width direction thereof can be produced, because the discharging means is conveyed at a constant velocity in the width direction of the collecting surface, and thus the fibers discharged from each discharging means and fiberized are dispersed all over the fibrous aggregate.

When the supplying and discharging step and the fibers-collecting step are carried out under the condition that an electrically conductive material is positioned in a part of or throughout the supplying pipe in the present method, an electrical field can be stably applied to the discharged fiberizable liquid, and thus, the fibrous aggregate having an even dispersion of the fiber amount in a width direction thereof can be reliably produced.

When the supplying and discharging step and the fibers-collecting step are carried out under the condition that a gas having a desired relative humidity is supplied around the discharging means, a relative humidity around the discharging means can be maintained at a desired level and an influence of an atmospheric humidity can be avoided, and so the fibrous aggregate containing the fibers having a uniform fiber diameter can be produced. Further, a solvent vaporized from the fiberizable liquid can be rapidly removed and an atmosphere around the discharging means does not reach a saturated vapor pressure, and so the fibrous aggregate can be continuously produced.

When the supplying and discharging step and the fibers-collecting step are carried out while an electrical field is applied from an outside of the endless track of the support in the present method, positions where the fibers discharged from the discharging means are accumulated on the collector can be controlled by applying the electrical field, and so the fibrous aggregate having an even dispersion of the fiber amount in a width direction thereof can be reliably produced.

According to the present apparatus, a fiberizable liquid can be discharged while rotationally conveying the means capable of discharging a fiberizable liquid, i.e., the discharging means, carried on the support along the endless track at a constant velocity, and thus, a fibrous aggregate having an even dispersion of the fiber amount in a width direction thereof can be produced. Further, the fibers constituting the fibrous aggregate are intersected with each other, and thus a resulting fibrous aggregate has an even mechanical strength in various directions thereof.

When the support has thereon two or more means capable of discharging a fiberizable liquid along the endless track in the present apparatus, an amount of the fiberizable liquid discharged can be increased, and so the fibrous aggregate can be manufactured with a good productivity. Further, even if the pore diameters of the discharging means are not uniform in size, the fibrous aggregate having an even dispersion of the fiber amount in a width direction thereof can be produced, because the discharging means is conveyed at a constant velocity in the width direction of the collecting surface, and thus the fibers discharged from each discharging means and fiberized can be dispersed all over the fibrous aggregate.

When an electrically conductive material is positioned in a part of or throughout the supplying pipe in the present apparatus, an electrical field can be stably applied to the discharged fiberizable liquid, and thus, the fibrous aggregate having an even dispersion of the fiber amount in a width direction thereof can be reliably produced.

When the present apparatus further comprises a means capable of supplying a gas having a desired relative humidity around the means for discharging a fiberizable liquid, an influence of an atmospheric humidity can be avoided, and so the fibrous aggregate containing the fibers having a uniform fiber diameter can be produced. Further, a solvent vaporized from the fiberizable liquid can be rapidly removed and an atmosphere around the discharging means does not reach a saturated vapor pressure, and so the fibrous aggregate can be continuously produced.

When the present apparatus further comprises a means capable of applying an electrical field from an outside of the endless track of the support, positions where the fibers discharged from the discharging means are accumulated on the collector can be controlled by applying the electrical field, and so the fibrous aggregate having an even dispersion of the fiber amount in a width direction thereof can be reliably produced.

| EXPLANATION OF NUMERICAL REFERENCES | |
|---|---|
| 1: | fiberizable liquid reservoir |
| 1a: | supplying pipe |
| $2_1$-$2_n$: | group of nozzles |
| 3: | supplying-discharging means |
| 4: | voltage applying means |
| 5: | collector |
| 6: | conveying means |
| 6a: | first sprocket |
| 6b: | second sprocket |
| 6c: | support |
| 7: | electrical field generating device |
| 8: | winding-up device |
| 9: | fiberizing room |
| 10: | gas supplying device |
| 10a: | porous material |
| 11: | gas exhausting device |
| 11a: | porous material |
| 12: | partition plate |

DESCRIPTION OF THE PREFERRED ENBODIMENTS

Figure 1:
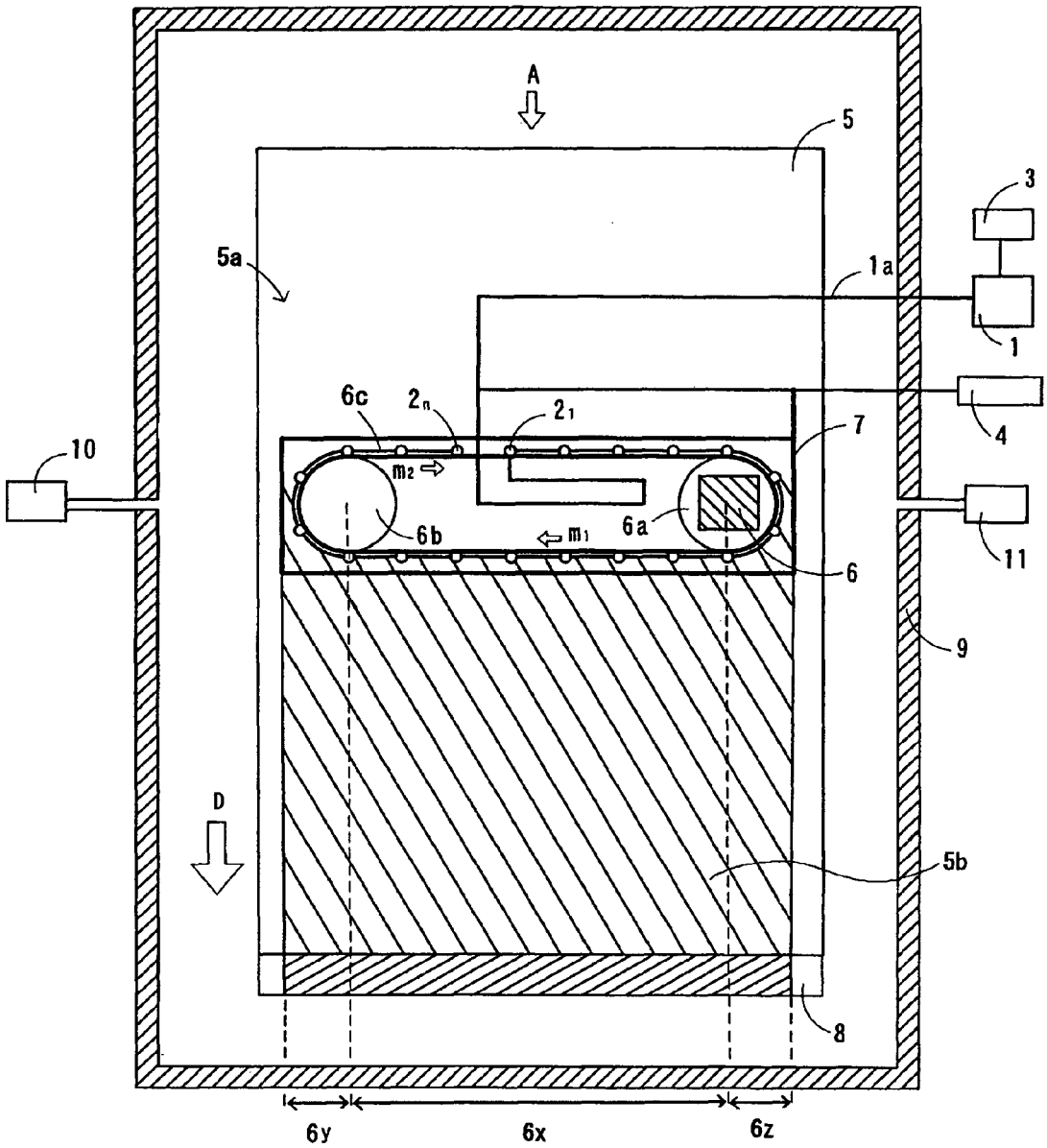
FIG. 1 is a plan view schematically illustrating the apparatus for producing the fibrous aggregate according to the present invention.
Figure 2:
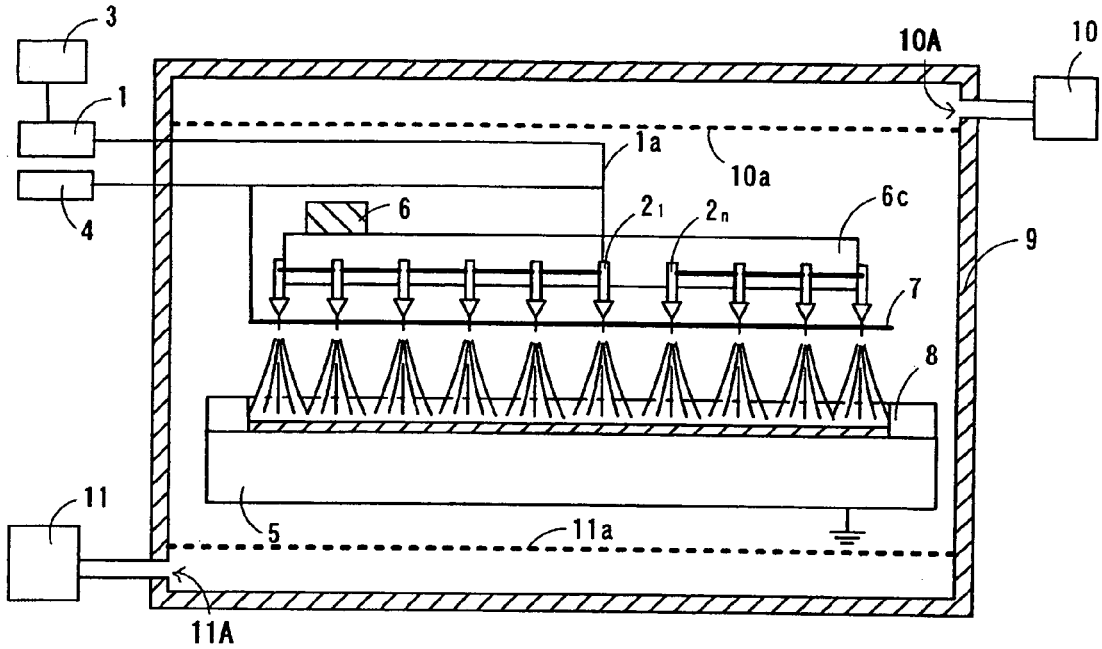
FIG. 2 is a sectional view schematically illustrating the apparatus of FIG. 1, observed from a direction of the arrow A.

The method and apparatus of producing fibrous aggregate according to the present invention will be described hereinafter, referring to FIGS. 1 and 2. FIG. 1 is a plan view schematically illustrating the producing apparatus, observed from above, and FIG. 2 is a sectional view schematically illustrating the apparatus of FIG. 1, observed from a direction of the arrow A.

The apparatus of producing the fibrous aggregate according to the present invention as shown in FIG. 1 comprises:

a means capable of storing a fiberizable liquid, i.e., a fiberizable liquid reservoir 1;

a group of nozzles $\mathbf{2}_1$ to $\mathbf{2}_n$ as a group of means capable of discharging a fiberizable liquid, i.e., a group of discharging means;

a supplying pipe 1*a* connecting the fiberizable liquid reservoir 1 and the group of the discharging means (the group of the nozzles $\mathbf{2}_1$ to $\mathbf{2}_n$) and capable of supplying the fiberizable liquid to the group of the discharging means;

a supplying and discharging means 3 capable of supplying a fiberizable liquid from the fiberizable liquid reservoir 1 to the group of the discharging means, and discharging the fiberizable liquid from the group of the discharging means;

a voltage applying means 4 capable of applying a voltage to the fiberizable liquid;

a collector 5 having a collecting surface 5*a* on which fiberized fibers are directly accumulated, capable of forming a fibrous aggregate 5*b* while the collecting surface 5*a* is unidirectionally conveyed in the direction D, and preferably being grounded;

a support 6*c* carrying thereon the group of the discharging means (the group of the nozzles $\mathbf{2}_1$ to $\mathbf{2}_n$) along the endless track capable of rotationally travelling between a pair of rotating shafts (between a first sprocket 6*a* and a second sprocket 6*b*), wherein moving directions m1, m2 of a linear motion area 6*x* in the endless track conforms to a width direction of the collecting surface 5*a*, i.e., a direction perpendicular to a moving direction D of the collecting surface 5*a;* a conveying means 6 capable of conveying the group of the discharging means (the group of the nozzles $\mathbf{2}_1$ to $\mathbf{2}_n$) in a width direction of the collecting surface 5*a* by conveying the support 6*c* in a width direction of the collecting surface 5*a* at a constant velocity;

an electrical field generating means 7 which is positioned outside the endless track (a circulating motion track) of the group of the nozzles $\mathbf{2}_1$ to $\mathbf{2}_n$, and able to apply an electrical field;

a winding-up device 8 capable of winding the fibrous aggregate formed on the collecting surface 5*a* into a roll at the end of the collector 5;

a fiberizing room 9 accommodating the group of the nozzles $\mathbf{2}_1$ to $\mathbf{2}_n$, the collector 5, and so on;

a gas supplying device 10 capable of supplying a desired gas into the fiberizing room 9; and a gas exhausting device 11 capable of evacuating a gas in the fiberizing room 9.

When the fibrous aggregate is manufactured by the producing apparatus as above, the fiberizable liquid first must be prepared. The fiberizable liquid is, for example, a solution containing in a solvent a dissolved resin which may be electrostatically spun. The resin is not limited so long as it can be electrostatically spun, but for example, polyethylene glycol, partially saponified polyvinyl alcohol, completely saponified polyvinyl alcohol, polyvinyl pyrrolidone, polylactic acid, polyglycolic acid, polyacrylonitirile, polymethacrylic acid, polymethyl methacrylate, polycarbonate, polystyrene, polyamide, polyimide, polyethylene, polypropylene, or the like. A resin other than the resins as exemplified above can be used. A fiberizable liquid prepared by dissolving two or more resins including the resins other than the exemplified resins in solvent can be used.

The solvent may be selected in accordance with the resin to be used, and thus is not limited. There may be mentioned as the solvent, for example, water, acetone, methanol, ethanol, propanol, isopropanol, tetrahydrofuran, dimethyl sulfoxide, 1,4-dioxane, pyridine, N,N-dimethylformamide, N,N-dimethylacetoamide, N-methyl-2-pyrrolidone, acetonitrile, formic acid, toluene, benzene, cyclohexane, cyclohexanone, carbon tetrachloride, methylene chloride, chloroform, trichloroethane, ethylene carbonate, diethyl carbonate, propylene carbonate, or the like. The solvent may be used alone, or a mixture of two or more solvents may be used.

The fiberizable liquid used in the present invention is prepared by dissolving at least one of the resins as above in at least one of the solvents. The concentration of the resin or resins may vary with a composition of the resins used, a molecular weight of the resin or resins, and/or the solvent or solvents, and thus is not limited. However, in view of the applicability to electrostatic spinning, the concentration corresponds to a viscosity of preferably 10 to 6000 mPa·s, more preferably 20 to 5000 mPa·s. If the viscosity is less than 10 mPa·s, the viscosity is too low to exhibit a sufficient spinability, and thus it is difficult to obtain fibers. If the viscosity is more than 6000 mPa·s, the fiberizable liquid becomes difficult to be drawn, and it is difficult to obtain fibers. The term "viscosity" as used herein means a value measured at 25° C. by an apparatus for measuring viscosity at a shear rate of 100 $s^{-1}$.

The fiberizable liquid as above is stored in the fiberizable liquid reservoir 1, and supplied via the supplying pipe 1*a* to the first nozzle $\mathbf{2}_1$ by the supplying-discharging means 3 equipped to connect the fiberizable liquid reservoir 1. From the first nozzle $\mathbf{2}_1$, the fiberizable liquid is supplied in turn to the nozzles $\mathbf{2}_2$ to $\mathbf{2}_n$, and then, the fiberizable liquid is discharged from the group of all the nozzles $\mathbf{2}_1$ to $\mathbf{2}_n$, this is, the supplying and discharging step. In the apparatus as shown in FIG. 1, the supplying pipe 1*a* is connected to an electric source (the applying means 4) so that a voltage can be applied to the fiberizable liquid in the supplying pipe 1*a*. The first nozzle $\mathbf{2}_1$ moves while carried on the support 6*c*, and so the supplying pipe 1*a* and the nozzle $\mathbf{2}_1$ are connected by, for example, a rotary joint. There may be an embodiment different from that as shown in FIG. 1, wherein the supplying pathway from the supplying pipe 1*a* may be diverged into two directions, one to the nozzle $\mathbf{2}_1$ and the other to the nozzle $\mathbf{2}_n$.

Further, there may be still another embodiment different from that as shown in FIG. 1, wherein the group of all the nozzles $\mathbf{2}_1$ to $\mathbf{2}_n$ may be divided into two supply pathways, and two kinds of fiberizable liquids are supplied to both supply pathways, respectively. More particularly, for example, a first fiberizable liquid is supplied to the first nozzle $\mathbf{2}_1$, and then, to the third nozzle $\mathbf{2}_3$ via the first nozzle $\mathbf{2}_1$ while circumventing the adjacent second nozzle $\mathbf{2}_2$, and further, to the fifth nozzle $\mathbf{2}_5$ while circumventing the adjacent fourth nozzle $\mathbf{2}_4$, in the similar manner, that is, the first fiberizable liquid is supplied to the first pathway composed of the group of the nozzles $\mathbf{2}_1$ to $\mathbf{2}_{n-1}$, successively. On the other hand, a second fiberizable liquid is supplied to the second nozzle $\mathbf{2}_2$, and then, to the fourth nozzle $\mathbf{2}_4$ via the second nozzle $\mathbf{2}_2$ while circumventing the adjacent third nozzle $\mathbf{2}_3$, and further, to the sixth nozzle $\mathbf{2}_6$ while circumventing the adjacent fifth nozzle $\mathbf{2}_5$, in the similar manner, that is, the second fiberizable liquid is supplied to the second pathway composed of the group of the nozzles $\mathbf{2}_2$-$\mathbf{2}_n$, successively. Consequently, a fibrous aggregate wherein two kinds of fibers are uniformly dispersed can be produced. Similarly, a fibrous aggregate wherein three or more kinds of fibers are uniformly dispersed can be produced by supplying three or more kinds of fiberizable liquids to each supply pathway.

As the fiberizable liquid reservoir 1, there may be mentioned, for example, a syringe, a tank of stainless steel, a plastic tank, or a bag of a resin, such as vinyl chloride or polyethylene. As the supplying-discharging means 3, for example, a syringe pump, a tube pump, a magnet type microgear pump, a micropump or a dispenser may be used. The supplying pipe 1*a* is preferably made of, for example, a pliable plastic tube, because it can be adjusted to the circulating revolutionary movement of the nozzle $\mathbf{2}_1$, particularly, a fluoroplastic, or polyolefin resin such as polypropylene or polyethylene, each having a chemical resistance.

In the producing apparatus according to the present invention, as shown in FIG. 1, the group of the discharging means, i.e., the group of the nozzles $\mathbf{2}_1$ to $\mathbf{2}_n$, can move linearly over the collecting surface 5*a* of the collector 5 in a width direction thereof, and the moving velocity of the group of the nozzles $\mathbf{2}_1$ to $\mathbf{2}_n$ can be maintained at a constant. Therefore, the apparatus makes it possible to obtain the fibrous aggregate having an even dispersion of the fiber amount in a width direction thereof. Further, even if the pore diameter of each nozzle is not uniform in size, the fibrous aggregate having an even dispersion of the fiber amount in a width direction thereof can be produced, because each nozzle is conveyed linearly at a constant velocity over the collecting surface 5*a* of the collector 5 in the width direction thereof, and thus the fibers discharged from each nozzle and fiberized are dispersed all over the fibrous aggregate. Furthermore, as shown in FIG. 1, the support 6*c* has the endless track capable of rotationally travelling between the rotating shafts, i.e., the first sprocket 6*a* and the second sprocket 6*b*, and thus includes two linear motion areas 6*x* which have moving directions m1 and m2 opposite to each other. When the group of the nozzles $\mathbf{2}_1$ to $\mathbf{2}_n$ carried on the support 6*c* is moving in the direction m1, the fibers discharged from the nozzles accumulate on the collecting surface 5*a* in a unidirectional and uniform orientation, that is, diagonally beneath a right direction on the collecting surface 5*a* shown in FIG. 1. On the other hand, when the group of the nozzles $\mathbf{2}_1$ to $\mathbf{2}_n$ carried on the support 6*c* is moving in the direction m2, the fibers discharged from the nozzles accumulate on the collecting surface 5*a* in a differently unidirectional and uniform orientation, that is, diagonally beneath a left direction on the collecting surface 5*a* shown in FIG. 1. Therefore, the fibers are intersected with each other on the collecting surface 5*a*, and thus a resulting fibrous aggregate has an even mechanical strength in various directions thereof.

Specifically, each nozzle is fixed on the chain support 6*c* respectively, and the support 6*c* bridges between the first sprocket 6*a* and the second sprocket 6*b*. A driving motor is positioned as the conveying means 6 at the first sprocket 6*a*, the first sprocket 6*a* can be rotated thereby. Thus, the support 6*c* can move between the first sprocket 6*a* and the second sprocket 6*b*, and consequently, the group of the nozzles $\mathbf{2}_1$ to $\mathbf{2}_n$ can move along the endless track in a circulating revolutionary manner. Alternatively, each nozzle may be fixed on a belt support respectively, and the support may bridge between the first pulley and the second pulley. A conveying means such as a driving motor may be positioned at the first or second pulley. In this case, the first and second pulleys can be rotated by the action of the driving motor, the support can move between the first and second pulleys, and consequently, the group of the nozzles can elliptically move in a circulating revolutionary manner.

In the producing apparatus as shown in FIG. 1, the group of two or more nozzles $\mathbf{2}_1$ to $\mathbf{2}_n$ is used as the dispersing means, and so the amount of the fiberizable liquid discharged can be increased to manufacture the fibrous aggregate with a good productivity. A nozzle pitch in the group of the nozzles $\mathbf{2}_1$ to $\mathbf{2}_n$ is preferably identical to each other, because the influence of an electric field from adjacent nozzles can be thus equalized. The nozzle pitch may vary with the resins and solvents contained in the fiberizable liquid, but can be determined by repeating appropriate experiments to uniformly discharge the fiberizable liquid in a large total amount.

Contrary to the embodiment as shown in FIG. 1, a single nozzle may be used to manufacture the fibrous aggregate. The moving velocity of the group of the nozzles $\mathbf{2}_1$ to $\mathbf{2}_n$ is not limited so long as it is constant, and the moving direction of the collecting surface of the collector is not limited so long as it is unidirectional. Further, the moving velocity of the collecting surface of the collector is not limited, but is preferably constant.

The direction of discharging the fiberizable liquid from the group of the nozzles $\mathbf{2}_1$ to $\mathbf{2}_n$ is not limited, but preferably the gravitational direction as shown in FIG. 2. In this case, the collecting surface of the collector is placed in such a position that the fibers gravitationally discharged can be received thereon.

The diameter of the nozzle in the group of the nozzles $\mathbf{2}_1$ to $\mathbf{2}_n$ may vary with the diameter of the desired fiber, and thus is not limited. For example, when the fiber diameter is 0.7 μm or less, the diameter (internal diameter) of each of the nozzles $\mathbf{2}_1$ to $\mathbf{2}_n$ is preferably 0.1 to 2.0 mm. All of the nozzles $\mathbf{2}_1$ to $\mathbf{2}_n$ may have a same diameter, each of the nozzles $\mathbf{2}_1$ to $\mathbf{2}_n$ may have different diameters, respectively, or a part of the nozzles $\mathbf{2}_1$ to $\mathbf{2}_n$ may have a same diameter. Each of the nozzles $\mathbf{2}_1$ to $\mathbf{2}_n$ may be made of metal or a non-metal. All of the nozzles $\mathbf{2}_1$ to $\mathbf{2}_n$ may be made of the same material, each of the nozzles $\mathbf{2}_1$ to $\mathbf{2}_n$ may be made of different materials, respectively, or a part of the nozzles $\mathbf{2}_1$ to $\mathbf{2}_n$ may be made of the same material. It is preferable that all of the nozzles $\mathbf{2}_1$ to $\mathbf{2}_n$ are made of a same material, because a same electrical field thus can be easily applied to the fiberizable liquid.

Instead of the nozzle used as the discharging means in the producing apparatus as shown in FIG. 1, a means other than the nozzle for discharging the fiberizable liquid may be used so long as it can discharge the fiberizable liquid while moving at a constant velocity in a width direction of the collecting surface of the collector.

In FIGS. 1 and 2, an embodiment of the producing apparatus wherein a single group of the nozzles $\mathbf{2}_1$ to $\mathbf{2}_n$ is placed on an elliptical endless track is shown. However, embodiments containing two or more groups of the discharging means are preferable, as the productivity of the fibrous aggregate is thereby enhanced. When two or more groups of the discharging means are arranged, the group of the discharging means as used in the producing apparatus shown in FIGS. 1 and 2 may be used. It is preferable to convey the groups at the same constant velocity or different constant velocities in a direction perpendicular to the moving direction of the collector. When plural groups of the discharging means are arranged, plural groups having nozzle diameters different from each group and/or plural groups to which the fiberizable liquid having a concentration different from each group is supplied may be used to manufacture a fibrous aggregate containing plural layers of the fibers with different fiber diameters. Further, plural groups to which the fiberizable liquid different from each group with respect to the kind of the resin or resins is supplied may be used to manufacture a fibrous aggregate containing plural layers of different compositions. Furthermore, when plural groups of the discharging means are arranged, adjacent groups may move in the same direction or opposite direction over the collecting surface of the collector.

Although not shown in the producing apparatus of FIG. 1, the supplying and discharging step and the fibers-collecting step as mentioned below are preferably carried out under the condition that an electrically conductive material is positioned in a part of or throughout the supplying pipe 1*a*. This ensures that an electrical field can be stably applied to the discharged fiberizable liquid, and thus, the fibrous aggregate having an even dispersion of the fiber amount in a width direction thereof can be reliably produced. More particularly, when air is incorporated into the supplying pipe 1*a*, application of an electrical field becomes unstable, and thus, the fiberization becomes unreliable. However, such problems may be solved by the existence of the electrically conductive material in the supplying pipe 1*a*. The term "electrically conductive material" as used herein means a material having a volume resistivity of $10^9$ Ω·m or less. The electrically conductive material used must exhibit a chemical resistance against the fiberizable liquid, because it is positioned therein. For this purpose, stainless steel wire may be preferably used as an electrically conductive material. Further, the electrically conductive material is preferably covered with a material, such as a polyethylene or fluorocarbon-based resin, having a chemical resistance against the fiberizable liquid, so that the fiberizable liquid does not adhere to the electrically conductive material. In this case, a part of the electrically conductive material must be exposed, to enable a voltage to be applied.

The fiberizable liquid discharged from the group of the nozzles $\mathbf{2}_1$ to $\mathbf{2}_n$ is drawn and fiberized by the action of the electric field generated by the grounded collector 5 and the voltage applied from the electric source (the applying means 4), and darts toward the collecting surface 5*a* of the collector 5. The fibers are accumulated directly on the collecting surface 5*a* of the collector 5 to form the fibrous aggregate (the fibers-collecting step).

In the embodiment as shown in FIGS. 1 and 2, a voltage is applied to the fiberizable liquid in the supplying pipe la by the applying means 4 and at the same time the collector 5 is grounded to form the electric field. On the contrary, an electric field may be formed by grounding the fiberizable liquid and applying a voltage to the collector 5, or alternatively by applying voltages to both of the fiberizable liquid and the collector 5, to generate a potential difference therebetween. The electric field may vary with the fiber diameter, a distance between the group of the nozzles $\mathbf{2}_1$ to $\mathbf{2}_n$ and the collecting surface 5*a* of the collector 5, the solvent of the fiberizable liquid, the viscosity of the fiberizable liquid, or the like, and is not limited, but is preferably 0.2 to 5 kV/cm. If the electric field is more than 5 kV/cm, a dielectric breakdown of air is liable to occur. If the electric field is less than 0.2 kV/cm, the fiberizable liquid is liable to be insufficiently drawn for forming a fiber shape.

An electric source as the voltage applying means 4 is not limited. For example, a DC high-voltage generator or Van De Graff electrostatic generator may be used. A voltage applied is not limited, so long as it may generate the electric field as above, but is preferably 5 to 50 kV.

A polarity of the voltage applied may be plus or minus. The polarity should preferably be confirmed, so that the spreading of the fibers is controlled and the fibrous aggregate composed of evenly dispersed fibers can be easily manufactured.

In the embodiment as shown in FIGS. 1 and 2, the voltage is applied to the fiberizable liquid in the supplying pipe 1*a* by the voltage applying means 4. On the contrary, the voltage may be applied to the group of the nozzles $\mathbf{2}_1$ to $\mathbf{2}_n$. In this case, two or more applying means may be used. For example, the applying means may be used in a number corresponding to numbers of nozzles used.

The collector 5 is not limited so long as it can accumulate directly on the collecting surface 5*a* the fibers (generally continuous fibers) discharged from the group of the nozzles as the group of means for discharging fiberizable liquid and then fiberized to form the fibrous aggregate. For example, a non-woven fabric, woven fabric, knitted fabric, net, drum, or belt made of an electrically conductive material such as metal or carbon, or an electrically non-conductive material such as an organic polymeric material may be used as the collector 5.

When the collector 5 is used as an electrode, it is preferably made of an electrically conductive material such as a metal having a specific resistance of $10^9$ Ω·cm or less. Further, when an electrically conductive material is positioned as a counter-electrode behind the collector 5 (when observed in a direction from the group of the nozzles $\mathbf{2}_1$ to $\mathbf{2}_n$ to the collector 5), the collector 5 is not necessarily made of an electrically conductive material. When such a counterelectrode is placed behind the collector 5 as above, the collector 5 may be brought into contact with the counterelectrode, or may be separated from the counterelectrode.

In the producing apparatus as shown in FIGS. 1 and 2, a rectangular wire (see FIG. 1) may be positioned as the electrical field generating means 7 in such a manner that it surrounds the endless track (circulating motion track) of the group of the nozzles $\mathbf{2}_1$ to $\mathbf{2}_n$ from the outside thereof, and is connected to the electric source as the voltage applying means 4. Therefore, the electric field can be applied by the wire to the fibers discharged from the group of the nozzles $\mathbf{2}_1$ to $\mathbf{2}_n$ and then fiberized to control the positions where the fibers discharged from the group of the nozzles $\mathbf{2}_1$ to $\mathbf{2}_n$ are accumulated on the collector. Thus, the fibrous aggregate having an even dispersion of the fiber amount in a width direction thereof can be reliably produced. In the embodiment as shown in FIG. 1, the wire is connected to the electric source also applying the voltage to the fiberizable liquid. On the contrary, the wire may be connected to another electric source. When the producing apparatus of the present invention is observed from above as in FIG. 1, the wire is so placed that it surrounds the periphery of the group of the nozzles $\mathbf{2}_1$ to $\mathbf{2}_n$. When the producing apparatus of the present invention is observed from the side thereof as in FIG. 2, the wire is so placed that it can generate the electric field at the area immediately below the discharging portions of the group of the nozzles $\mathbf{2}_1$ to $\mathbf{2}_n$. With respect to the wire and the group of the nozzles $\mathbf{2}_1$ to $\mathbf{2}_n$ in the producing apparatus as shown in FIGS. 1 and 2, the positional relationship thereof in the horizontal direction and a distance therebetween in the vertical direction may vary with an electric field strength between the group of the nozzles $\mathbf{2}_1$ to $\mathbf{2}_n$ and the collector 5, a shape of the wire, fiberizing conditions such as the kind and the discharged amount of the fiberizable liquid, the applied voltage, or the like. Thus, they can be appropriately determined by pilot tests.

In the producing apparatus of the present invention as shown in FIG. 1, the winding-up device 8 is positioned at the end of the collector 5. Thus, the fibrous aggregate can be wound up, and the fibrous aggregate can be continuously manufactured.

In the producing apparatus of the present invention as shown in FIGS. 1 and 2, the group of the nozzles $\mathbf{2}_1$ to $\mathbf{2}_n$, the collector 5, the electrical field generating means 7, and the winding-up device 8 as above are accommodated in the fiberizing room 9 which is equipped with the gas supplying device 10 and the gas exhausting device 11. Therefore, an atmosphere in the fiberizing room may be given a desirable fiberization atmosphere and the desirable fiberization atmosphere can be easily maintained. For example, a gas having a predetermined relative humidity can be supplied from the gas supplying device 10 to alter the fiberization atmosphere in the fiberizing room 9 to a predetermined relative humidity, and to maintain the predetermined relative humidity. Thus, an influence of the relative humidity to the fiberizable liquid can be controlled constantly by altering and maintaining the predetermined relative humidity, and the fibrous aggregate containing the fibers having uniform fiber diameters can be produced. The gas supplying device 10 may be, for example, a propeller fan, a sirocco fan, an air compressor, an air blower, or the like. The gas inlet from the gas supplying device 10 may be positioned on the side wall of the fiberizing room 9 as in the embodiment shown in FIGS. 1 and 2, or on the ceiling plane thereof. Further, as shown in FIG. 2, it is preferable to install the porous material 10*a*, such as a metal or resin punching plate, or a woven or non-woven fabric, downstream of the gas inlet 10A and control an amount of the gas supplied from the gas supplying device 10 into the fiberizing space at a constant level.

In the producing apparatus as shown in FIG. 2, the gas exhausting device 11 can be used to remove the gas from the fiberizing room 9. During the electrostatic spinning, a vapor concentration of the solvent is gradually elevated in the fiberizing room 9, and thus the vaporization of the solvent is inhibited. Then, the fiber diameter is liable to be thinner and non-uniform. In the worst case, the vapor concentration of the solvent becomes saturated, and the electrostatic spinning becomes difficult to carry out. The gas can be exhausted to control the vapor concentration of the solvent at a constant level in the fiberizing room 9, and thus manufacture the fibrous aggregate containing the fibers having a uniform fiber diameter. The gas exhausting device 11 is not limited, but is, for example, a fan positioned at the gas outlet 11A. When a gas is supplied to the fiberizing room 9 by the gas supplying device 10 as shown in FIG. 2, a gas having a volume the same as that of the supplied gas can be evacuated merely by the equipment of the gas outlet 11A, and thus, the gas exhausting device 11 is not always necessary. When the gas is evacuated by the gas exhausting device 11 as shown in FIG. 2, the amount of gas evacuated is preferably the same as that of the supplied gas. This is because that, if the amount of the evacuated gas is different from that of the supplied gas, a pressure in the fiberizing room 9 varies, a rate of the vaporization of the solvent varies, and the fiber diameters become non-uniform. The gas outlet 11A to the gas exhausting device 11 may be positioned on the side wall of the fiberizing room 9 as in the embodiment shown in FIG. 2, or on the bottom wall thereof. Further, it is preferable to install the porous material 11*a*, such as a metal or resin punching plate, or a woven or non-woven fabric, upstream of the gas outlet 11A, and thereby form a uniform gas stream from above to the bottom in the fiberizing room 9, and thus constantly control the atmosphere and a gas amount.

Figure 3:
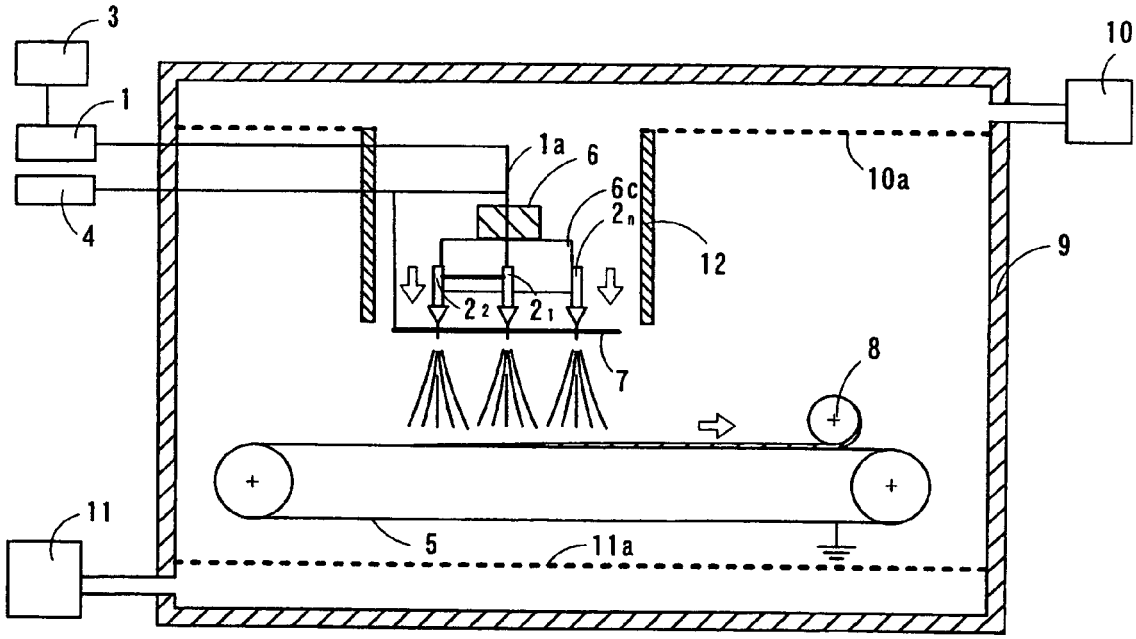
FIG. 3 is a sectional view schematically illustrating another embodiment of the apparatus for producing the fibrous aggregate according to the present invention.

When the supplying and discharging step and the fibers-collecting step are carried out, while supplying a gas having a desired relative humidity around the discharging means of the fiberizable liquid from a gas-supplying means provided to the apparatus and capable of supplying the gas having a desired relative humidity around the discharging means, the fibrous aggregate containing the fibers having a uniform fiber diameter can be manufactured without the influence of humidity. Further, the solvent vaporized from the fiberizable liquid can be rapidly removed, and the vapor pressure around the discharging means can be prevented from becoming saturated. Thus, the fibrous aggregate can be continuously manufactured. An apparatus containing the gas-supplying means capable of supplying a gas having a desired relative humidity around the discharging means of the fiberizable liquid is illustrated in FIG. 3. FIG. 3 is a schematic sectional view observed from a direction perpendicular to the conveying direction of the collector. In the producing apparatus of the present invention as shown in FIG. 3, the partition plate 12 is placed outside the endless track of the group of the nozzles $\mathbf{2}_1$ to $\mathbf{2}_n$, so that it surrounds the group of the nozzles $\mathbf{2}_1$ to $\mathbf{2}_n$ and a gas having a desired relative humidity can be supplied around the nozzles. A distance between the partition plate 12 and the group of the nozzles $\mathbf{2}_1$ to $\mathbf{2}_n$ in the horizontal direction and a positional relationship thereof in the vertical direction may vary with an electric field strength between the group of the nozzles $\mathbf{2}_1$ to $\mathbf{2}_n$ and the collector 5, fiberizing conditions such as the kind and the discharged amount of the fiberizable liquid, the applied voltage, or the like. Thus, they can be appropriately determined by repeated experiment. The producing apparatus shown in FIG. 3 has the same construction as that of the producing apparatus shown in FIGS. 1 and 2, except that the former has the partition plate 12.

In the producing apparatus shown in FIG. 3, the porous material 10*a* is equipped with the partition plate 12. Alternatively, a non-porous material may be installed instead of the porous material 10*a*, and equipped with the partition plate 12 so that it surrounds the group of the nozzles $\mathbf{2}_1$ to $\mathbf{2}_n$. In this case, only the area of the partition plate 12 is porous or opens. Alternatively, the porous material 10*a*, the non-porous material, or the ceiling plane of the fiberizing room 9 may be equipped with a partition plate 12 so that it surrounds the group of the nozzles $\mathbf{2}_1$ to $\mathbf{2}_n$, and at the same time, a gas-supplying means may be installed so that it is connected directly with the partition plate, whereby a gas having a desired relative humidity can be supplied around the nozzles. In this case, a gas-supplying means capable of supplying a gas having a desired relative humidity throughout the fiberizing room 9 can also be installed.

The expression "around the discharging means of the fiberizable liquid" as used herein means a hypothetical pace surrounded by (1) a circular top wall having a diameter of 50 mm and a circular center at the center of the discharging means of the fiberizable liquid (i.e., a tip of the individual nozzle in FIG. 3) and (2) a cylindrical column having a height of 50 mm and elongating from the circular top wall to a direction parallel to the discharging direction of the fiberizable liquid. The relative humidity may vary with a desired diameter of the fiber, and be appropriately determined by repeated tests.

According to the producing method and apparatus of the present invention, the fibrous aggregate having an even dispersion of the fiber amount all round and having a coefficient of variation of 3% or less can be easily produced. A method for measuring the coefficient of variation will be described in the Examples as below.

When an insulating plate, such as a polyvinyl chloride or acrylic resin plate, is positioned at both sides of the collector or as the partition plate, the insulating plate is electrically charged with a same polarity to that of the fiberizable liquid, by the electrical field generated by the electrical charges of the fiberizable liquid discharged from the discharging means, whereby an electrically repulsive force on the surface of the insulating plate can prevent the fiberizable liquid, and accordingly, the fibers, from spreading, and thus, the positions where the fibers are accumulated can be controlled. Therefore, the fibrous aggregate having even dispersion of the fiber amount can be easily manufactured.

Before winding up, the fibrous aggregate is preferably dried. The drying can prevent the wound up fibrous aggregates from adhering to each other. This is because when the solvent constituting the fiberizable liquid remains, the fibrous aggregates may be adhered to each other thereby.

It is preferable that, in the fibrous aggregate formed on the collecting surface 5*a* of the collector 5 according to the present producing apparatus shown in FIGS. 1 and 2, an area (the area 6*z* in FIG. 1) outside from the center of the first sprocket 6*a* and an area (the area 6*y* in FIG. 1) outside from the center of the second sprocket 6*b* are removed as a selvage, and a remaining area (the area 6*x* in FIG. 1) between the center of the first sprocket 6*a* and the center of the second sprocket 6*b* is used as the fibrous aggregate.

In the present invention, a ratio of the major axis (longitudinal diameter) and the minor axis (lateral diameter) of the endless track is not limited. However, the ratio (L/S) of the major axis (L) to the minor axis (S) is preferably more than 2, more preferably 3 or more. If the ratio (L/S) is 2 or less, the ratio of the linear motion area of the means capable of discharging the fiberizble liquid (nozzles) becomes relatively lower, and thus, it is not preferable with respect to a productivity.

EXAMPLES

The present invention will now be further illustrated by, but is by no means limited to, the following Examples.

Examples 1 and 2

(1) Preparation of Fiberizable Liquid

A fiberizable liquid (viscosity: 1200 mP·s) was prepared by dissolving polyacrylonitrile of a weight average molecular weight of 400 thousands in N,N-dimethylformamide to a concentration of 12 mass %.

(2) Assembly of the Apparatus of Production

A producing apparatus as shown in FIGS. 1 and 2 was assembled. More particularly, a group of fourteen (14) nozzles $\mathbf{2}_1$ to $\mathbf{2}_{14}$ (a needle-like stainless steel nozzle having an internal diameter of 0.4 mm, respectively) was fixed on a chain support 6*c* at a respective pitch of 60 mm. A bridge of the support 6*c* was formed between a first sprocket 6*a* and a second sprocket 6*b*, whereby the group of the nozzles $\mathbf{2}_1$ to $\mathbf{2}_{14}$ was arranged in a form of an ellipse (longitudinal diameter=480 mm; lateral diameter 140 mm). Further, a driving motor (the conveying means 6) was positioned on the first sprocket 6*a*.

Then, a polyethylene flexible bag (fiberizable liquid reservoir 1) was connected to a micropump (manufactured by Micropump; Micropump FC-513 Pumphead: 188 1 rpm=0.017 mL type: Controller manufactured by Chuorika Co., Ltd.) (the supplying-discharging means 3) and a perfluoroalkoxy resin tube (the supplying pipe 1*a*) which in turn was connected to the nozzle $\mathbf{2}_1$ via a rotary joint. The nozzle $\mathbf{2}_1$ was connected to the adjacent nozzle $\mathbf{2}_2$ via a tube (the supplying pipe 1*a*) similar to the above tube, thereby allowing the fiberizable liquid to be supplied via the nozzle $\mathbf{2}_1$ to the nozzle $\mathbf{2}_2$. In the same manner, the nozzle $\mathbf{2}_2$ and the nozzle $\mathbf{2}_3$, the nozzle $\mathbf{2}_3$ and the nozzle $\mathbf{2}_4$, and up to the nozzle $\mathbf{2}_{14}$ were connected via a similar tube (the supplying pipe 1*a*) one after another, to thereby allow the fiberizable liquid to be supplied up, to the nozzle $\mathbf{2}_{14}$. A stainless steel wire (the electrically conductive material) having a diameter of 0.1 mm was inserted in the supplying pipe 1*a*.

Thereafter, the belt collector 5 (width=500 mm) made of a steel belt coated with an electrically conductive silicone rubber was grounded and positioned below the group of the nozzles $\mathbf{2}_1$ to $\mathbf{2}_{14}$. The fiberizable liquid reservoir was connected to a high-voltage electric source 4, and the group of the nozzles $\mathbf{2}_1$ to $\mathbf{2}_{14}$ was positioned so that the tips of the group of the nozzles $\mathbf{2}_1$ to $\mathbf{2}_{14}$ downwardly faced the belt collector 5 from above, and the direction of the longitudinal diameter of the endless track of the group of the nozzles $\mathbf{2}_1$ to $\mathbf{2}_{14}$ conformed to the width direction (a direction perpendicular to the conveying direction) of the belt collector 5. The distance between the tips of the group of the nozzles $\mathbf{2}_1$ to $\mathbf{2}_{14}$ and the collecting surface 5*a* of the belt collector 5 was 100 mm.

Subsequently, the group of the nozzles $\mathbf{2}_1$ to $\mathbf{2}_{14}$ and the belt collector 5 were placed at the center of a fiberizing cuboid room 9 (width=800 mm; height=1300 mm; depth=1800 mm) of polyvinyl chloride. A polyvinyl chloride punching plate (the porous material 10*a*) was placed parallel to the ceiling plane at a position of 500 mm below from the ceiling plane, and a polyvinyl chloride punching plate (the porous material 11*a*) was placed parallel to the bottom plane at a position of 100 mm above from the bottom plane. A paper tube was positioned as the winding-up device 8 at the end of conveying direction of the belt collector 5. The paper tube was able to rotate in accordance with the conveying movement of the belt collector 5, and wind up the fibrous aggregate.

Then, a temperature-humidity controlling air blower (PAU-1400HDR, Apiste Corp.; the gas supplying device 10) was connected to the ceiling plane of the fiberizing cuboid room 9, and an exhaust fan(the gas exhausting device 11) was connected to the bottom plane of the fiberizing cuboid room 9.

(3) Production of Fibrous Aggregate

The fiberizable liquid was introduced into the fiberizable liquid reservoir 1, and supplied to the group of the nozzles $\mathbf{2}_1$ to $\mathbf{2}_{14}$ via the nozzle $\mathbf{2}_1$ by the micropump. The fiberizable liquid was discharged from each nozzle in an amount of 2 g/hour per one nozzle, while the group of the nozzles $\mathbf{2}_1$ to $\mathbf{2}_{14}$ was conveyed at a constant velocity of 125 mm/sec in such a manner that the moving directions m1, m2 of the linear motion area 6*x* of the endless track conformed to the width direction of the collecting surface 5*a*, i.e., a direction perpendicular to the moving direction D of the collecting surface 5*a*. While the belt collector 5 was conveyed at a constant surface velocity of 2.4 cm/minute in Example 1 and 0.9 cm/minute in Example 2, a voltage of +15 kV was applied to the fiberizable liquid by the high-voltage electric source 4 to apply an electrical field to the discharged fiberizable liquid and fiberize the fiberizable liquid. The fibers were accumulated on the belt collector 5 to produce the fibrous aggregate composed of continuous fibers having an average fiber diameter of 0.42 μm. During the production procedures of the fibrous aggregate, a humidified air having a temperature of 25° C. and a relative humidity of 25% was supplied at a rate of 5 $m^3$/minute by the gas supplying device 10, and a gas from the gas outlet was evacuated by the exhaust fan 11.

Comparative Example 1

(1) Assembly of the Apparatus of Production

Four tubes carrying nozzles wherein a group of eight nozzles (a needle-like stainless steel nozzle having an internal diameter of 0.4 mm, respectively) was linearly positioned at an identical pitch of 30 mm on a linear stainless steel tube were provided. More particularly, a group of eight nozzles $\mathbf{2}_{11}$ to $\mathbf{2}_{18}$ was fixed linearly on a first stainless steel tube, a group of eight nozzles $\mathbf{2}_{21}$ to $\mathbf{2}_{28}$ was fixed linearly on a second stainless steel tube, a group of eight nozzles $\mathbf{2}_{31}$ to $\mathbf{2}_{38}$ was fixed linearly on a third stainless steel tube, and a group of eight nozzles $\mathbf{2}_{41}$ to $\mathbf{2}_{48}$ was fixed linearly on a fourth stainless steel tube. Each stainless steel tube from the first stainless steel tube to the fourth stainless steel tube was positioned so that the longitudinal direction thereof conformed to a direction perpendicular to the moving direction of the belt collector (width=500 mm) which was placed under each stainless steel tube, that is, parallel to the width direction of the belt collector. Further, four stainless steel tubes were positioned in such a manner that a positional relationship between the group of the nozzles $\mathbf{2}_{11}$ to $\mathbf{2}_{18}$ of the first stainless steel tube and the group of the nozzles $\mathbf{2}_{21}$ to $\mathbf{2}_{28}$ of the second stainless steel tube was such that each nozzle in one group was zigzaggedly shifted from each nozzle in the other group by ¼ pitch in the width direction of the belt collector; a positional relationship between the group of the nozzles $\mathbf{2}_{21}$ to $\mathbf{2}_{28}$ of the second stainless steel tube and the group of the nozzles $\mathbf{2}_{31}$ to $\mathbf{2}_{38}$ of the third stainless steel tube was such that each nozzle in one group was zigzaggedly shifted from each nozzle in the other group by ¼ pitch in the width direction of the belt collector; and a positional relationship between the group of the nozzles $2_{31}$ to $2_{38}$ of the third stainless steel tube and the group of the nozzles $2_{41}$ to $2_{48}$ of the fourth stainless steel tube was such that each nozzle in one group was zigzaggedly shifted from each nozzle in the other group by ¼ pitch in the width direction of the belt collector. The first stainless steel tube to the fourth stainless steel tube were connected to an electrically-driven actuator so that the first stainless steel tube to the fourth stainless steel tube were able to integrally reciprocate as a whole in the width direction of the collector 5.

Then, similar to the apparatus shown in FIGS. 1 and 2, a polyethylene flexible bag (fiberizable liquid reservoir 1) was connected to a micropump (manufactured by Micropump; Micropump FC-513 Pumphead: 188 1 rpm=0.017 mL type: Controller manufactured by Chuorika Co., Ltd.) (the supplying-discharging means). To each of the first stainless steel tube to the fourth stainless steel tube, a perfluoroalkoxy resin tube (the supplying pipe 1*a*) was connected, respectively, to thereby allow the fiberizable liquid to be supplied to all of the nozzles $2_{11}$ to $2_{48}$.

Thereafter, similar to the apparatus shown in FIGS. 1 and 2, a belt collector (width=500 mm; the belt collector 5) made of a steel belt coated with an electrically conductive silicone rubber was grounded and positioned below the group of the nozzles $2_{11}$ to $2_{48}$. The polyethylene flexible bag (fiberizable liquid reservoir 1) was connected to a high-voltage electric source (high-voltage electric source 4), and the group of the nozzles was positioned so that the tips of the group of the nozzles $2_{11}$ to $2_{48}$ downwardly faced the belt collector from above, and the direction of the linear position of each group of nozzles conformed to the width direction (a direction perpendicular to the conveying direction) of the belt collector. The distance between the tips of the group of the nozzles $2_{11}$ to $2_{48}$ and the collecting surface of the belt collector was 100 mm.

Subsequently, the group of the nozzles $2_{11}$ to $2_{48}$ and the belt collector were placed at the center of a fiberizing cuboid room (fiberizing room 9; width=800 mm; height=1300 mm; depth=1800 mm) of polyvinyl chloride. A polyvinyl chloride punching plate (the porous material 10*a*) was placed parallel to the ceiling plane at a position of 500 mm below from the ceiling plane, and a polyvinyl chloride punching plate (the porous material 11*a*) was placed parallel to the bottom plane at a position of 100 mm above from the bottom plane. A paper tube was positioned as a winding-up device (the winding-up device 8) at the end of the conveying direction of the belt collector. The paper tube was able to rotate in accordance with the conveying movement of the belt collector, and wind up the fibrous aggregate.

Then, a temperature-humidity controlling air blower (PAU-1400HDR, Apiste Corp.; the gas supplying device 10) was connected to the ceiling plane of the fiberizing cuboid room, and an exhaust fan (the gas exhausting device 11) was connected to the bottom plane of the fiberizing cuboid room.

(2) Production of Fibrous Aggregate

The same fiberizable liquid as that used in Examples 1 and 2 was introduced into the fiberizable liquid reservoir, and supplied to the group of the nozzles $2_{11}$ to $2_{48}$ by the micropump. The fiberizable liquid was discharged from each nozzle in an amount of 1 g/hour per one nozzle, while the groups of the nozzles $2_{11}$ to $2_{48}$ were reciprocated at a constant velocity of 20 mm/sec in a direction identical to the width direction of the belt collector (reciprocating width=40 mm). While the belt collector was conveyed at a constant surface velocity of 5 cm/minute, a voltage of 17 kV was applied to the fiberizable liquid by the high-voltage electric source to apply an electrical field to the discharged fiberizable liquid and fiberize the fiberizable liquid. The fibers were accumulated on the belt collector to produce the fibrous aggregate composed of continuous fibers having an average fiber diameter of 0.43 μm. During the production procedures of the fibrous aggregate, a humidified air having a temperature of 25° C. and a relative humidity of 25% was supplied at a rate of 5 $m^3$/minute by a gas supplying device (the gas supplying device 10), and a gas from the gas outlet was evacuated by the exhaust fan (the gas exhausting device 11).

The resulting fibrous aggregate included many stripes elongating in a direction identical to the conveying direction of the collector and had a poor texture. This seemed to be due to the temporary stops in the reciprocating movement.

Comparative Example 2

(1) Assembly of the Apparatus of Production

Ten nozzles $2_1$ to $2_{10}$ (a needle-like stainless steel nozzle having an internal diameter of 0.4 mm, respectively) were linearly positioned at a pitch of 30 mm on a linear stainless steel tube. The stainless steel tube was then positioned over a belt collector (the collector 5; width=500 mm) so that the longitudinal direction of the stainless steel tube became parallel to the moving direction of the belt collector, that is, perpendicular to the width direction of the belt collector. The stainless steel tube was connected to an electrically-driven actuator so that it was able to reciprocate in the width direction of the collector.

Then, a polyethylene flexible bag (fiberizable liquid reservoir 1) was connected to a micropump (manufactured by Micropump; Micropump FC-513 Pumphead: 188 1 rpm=0.017 mL type: Controller manufactured by Chuorika Co., Ltd.) (the supplying-discharging means). To the stainless steel tube to which the group of the nozzles $2_1$ to $2_{10}$ was fixed, a perfluoroalkoxy resin tube (the supplying pipe 1*a*) was connected, to thereby allow the fiberizable liquid to be supplied to the group of the nozzles $2_1$ to $2_{10}$.

Thereafter, similar to the apparatus shown in FIGS. 1 and 2, a belt collector (width=500 mm) made of a steel belt coated with an electrically conductive silicone rubber was grounded and positioned below the group of the nozzles $2_1$ to $2_{10}$. The polyethylene flexible bag (fiberizable liquid reservoir 1) was connected to a high-voltage electric source (high-voltage electric source 4), and the group of the nozzles $2_1$ to $2_{10}$ was positioned so that the tips of the group of the nozzles $2_1$ to $2_{10}$ downwardly faced the belt collector from above, and the direction of the linear position of the group of nozzles $2_1$ to $2_{10}$ conformed to a direction parallel to the conveying direction of the belt collector. The distance between the tips of the group of the nozzles $2_1$ to $2_{10}$ and the collecting surface of the belt collector was 100 mm.

Subsequently, the group of the nozzles $2_1$ to $2_{10}$ and the belt collector were placed at the center of a fiberizing cuboid room (fiberizing room 9; width=800 mm; height=1300 mm; depth=1800 mm) of polyvinyl chloride. A polyvinyl chloride punching plate (the porous material 10*a*) was placed parallel to the ceiling plane at a position of 500 mm below from the ceiling plane, and a polyvinyl chloride punching plate (the porous material 11*a*) was placed parallel to the bottom plane at a position of 100 mm above from the bottom plane. A paper tube was positioned as a winding-up device (the winding-up device 8) at the end of conveying direction of the belt collector. The paper tube was able to rotate in accordance with the conveying movement of the belt collector, and wind up the fibrous aggregate.

Then, a temperature-humidity controlling air blower (PAU-1400HDR, Apiste Corp.; the gas supplying device 10) was connected to the ceiling plane of the fiberizing cuboid room, and an exhaust fan (the gas exhausting device 11) was connected to the bottom plane of the fiberizing cuboid room.

(2) Production of Fibrous Aggregate

The same fiberizable liquid as that used in Examples 1 and 2 was introduced into the fiberizable liquid reservoir, and supplied to the group of the nozzles $\mathbf{2}_1$ to $\mathbf{2}_{10}$ by the micropump. The fiberizable liquid was discharged from each nozzle in an amount of 2 g/hour per one nozzle, while the groups of the nozzles $\mathbf{2}_1$ to $\mathbf{2}_{10}$ were reciprocated at velocity of 300 mm/sec in a direction identical to the width direction of the belt collector (reciprocating width=330 mm). While the belt collector was conveyed at a constant surface velocity of 0.8 cm/minute, a voltage of 15 kV was applied to the fiberizable liquid by the high-voltage electric source to apply an electrical field to the discharged fiberizable liquid and fiberize the fiberizable liquid. The fibers were accumulated on the belt collector to produce the fibrous aggregate composed of continuous fibers having an average fiber diameter of 0.43 μm. During the production procedures of the fibrous aggregate, a humidified air having a temperature of 25° C. and a relative humidity of 25% was supplied at a rate of 5 $m^3$/minute by a gas supplying device (the gas supplying device 10), and a gas from the gas outlet was evacuated by the exhaust fan (the gas exhausting device 11).

Evaluation of the Fibrous Aggregates (1) Preparation of Strip Samples

Regarding the products prepared in Examples 1 and 2, an area (the area 6*z* in FIG. 1) outside from the center of the first sprocket 6*a* and an area (the area 6*y* in FIG. 1) outside from the center of the second sprocket 6*b* were removed as a selvage, and the remaining areas (the area 6*x* in FIG. 1) between the center of the first sprocket 6*a* and the center of the second sprocket 6*b* were used as the fibrous aggregates of Examples 1 and 2. Regarding the product prepared in Comparative Example 1, both side areas from the edges to the inner lines of 40 mm therefrom were cut off, and the remaining central area was used as the fibrous aggregates of Comparative Example 1. Regarding the product prepared in Comparative Example 2, both side areas from the edges to the inner lines of 40 mm therefrom were cut off, and the remaining central area was used as the fibrous aggregates of Comparative Example 2.

Plural strip samples were taken off in a lateral direction from each of the fibrous aggregates. More particularly, each strip sample had a size of 5 cm in the moving direction of the collector and 2 cm in the width direction of the collector. Plural strip samples were taken laterally from one edge to the other edge of each of the fibrous aggregates.

(2) Measurement of Coefficient of Variation

A mass (=fiber mass) of each strip sample was measured, and converted to a mass per 1 $m^2$ of each strip sample. Then, a coefficient of variation (CV value) of each strip sample was calculated from the above mass per unit area. The result is shown in Table 1.

(3) Results

TABLE 1

| | coefficient of variation (%) |
|---|---|
| Example 1 | 2.20 |
| Example 2 | 1.38 |
| Comparative Example 1 | 5.09 |
| Comparative Example 2 | 3.59 |

As shown in Table 1, it is apparent that the fibrous aggregate having a small coefficient of variation, and a uniform and even dispersion of the fiber amount in the width direction can be obtained in accordance with the producing method and apparatus of the present invention.

The invention claimed is:

1. A method of producing a fibrous aggregate, comprising:

a supplying and discharging step wherein a fiberizable liquid is supplied from a means for storing said fiberizable liquid to a means for discharging said fiberizable liquid via a supplying pipe, and said fiberizable liquid is discharged from said discharging means in the direction of gravity; and a fibers-collecting step wherein fibers are drawn and fiberized by applying an electrical field to said discharged fiberizable liquid and are accumulated directly on a collecting surface of a belt collector while said collecting surface is unidirectionally conveyed to form said fibrous aggregate;

wherein said discharging means is carried on a support capable of moving along an elliptical endless track capable of rotationally traveling between a pair of rotating shafts and including two linear motion areas which have moving directions opposite to each other, said fiberizable liquid is discharged from said discharging means while said support is revolved at a constant velocity under a condition that a moving direction of a linear motion area in said endless track conforms to a width direction of said collecting surface, and said fibers discharged from the two linear motion areas are accumulated on the same belt collector.

2. The method according to claim 1, wherein said support carries thereon two or more means for discharging a fiberizable liquid.

3. The method according to claim 1, wherein said supplying and discharging step and said fibers-collecting step are carried out under the condition that an electrically conductive material is positioned in a part of or throughout said supplying pipe.

4. The method according to claim 1, wherein said supplying and discharging step and said fibers-collecting step are carried out under a condition that a gas having a desired relative humidity is supplied around said means for discharging a fiberizable liquid.

5. The method according to claim 1, wherein said supplying and discharging step and said fibers-collecting step are carried out while an electrical field is applied from outside said endless track of said support.

6. An apparatus for producing a fibrous aggregate in accordance with claim 1, comprising:

a means capable of storing a fiberizable liquid;

a means capable of discharging said fiberizable liquid;

a supplying pipe connecting said storing means and said discharging means;

a supplying and discharging means capable of supplying said fiberizable liquid from said storing means to said discharging means, and discharging said fiberizable liquid from said discharging means in the direction of gravity;

a voltage applying means capable of applying an electrical field to said fiberizable liquid discharged by an action of said supplying and discharging means to conduct drawing and fiberization of fibers;

a belt collector having a collecting surface on which fiberized fibers are directly accumulated, and capable of forming said fibrous aggregate while said collecting surface is unidirectionally conveyed;

a support capable of moving along an elliptical endless track capable of rotationally traveling between a pair of rotating shafts and including two linear motion areas which have moving directions opposite to each other, and carrying thereon said discharging means so that said discharging means is able to be conveyed along said endless track, wherein a moving direction of a linear motion area in said endless track conforms to a width direction of said collecting surface; and a means capable of rotationally conveying said support along said endless track at a constant velocity, wherein said fibers discharged from the two linear motion areas are accumulated on the same belt collector.

7. The apparatus according to claim 6, wherein said support carries thereon two or more means capable of discharging a fiberizable liquid.

8. The apparatus according to claim 6, wherein an electrically conductive material is positioned in a part of or throughout said supplying pipe.

9. The apparatus according to claim 6, further comprising a means capable of supplying a gas having a desired relative humidity around said means for discharging a fiberizable liquid.

10. The apparatus according to claim 6, further comprising a means capable of applying an electrical field from outside said endless track of said support.

* * * * *